US005255911A

United States Patent [19]

Preston et al.

[11] Patent Number: 5,255,911

[45] Date of Patent: Oct. 26, 1993

[54] TETHERED BALL PITCHING APPARATUS AND METHOD

[75] Inventors: George D. Preston, San Dimas; Timothy E. Kearney, Diamond Bar; Thomas A. Phelan, Moreno Valley; John W. Tulac, Covina, all of Calif.

[73] Assignee: Preston Sports Product Corporation, San Dimas, Calif.

[21] Appl. No.: 770,189

[22] Filed: Oct. 2, 1991

Related U.S. Application Data

[62] Division of Ser. No. 613,277, Nov. 14, 1990, Pat. No. 5,056,781.

[51] Int. Cl.[5] ..... A63B 69/40

[52] U.S. Cl. ..... 273/26 E

[58] Field of Search ..... 273/29 A, 269, 184 B, 273/413, 26 E

[56] References Cited

U.S. PATENT DOCUMENTS

| | | | |
|---|---|---|---|
| 3,166,317 | 1/1965 | Tumelson | 273/26 E |
| 3,214,166 | 10/1965 | Gaudet | 273/26 E |
| 4,158,458 | 6/1979 | Gomez | 273/413 |
| 4,191,372 | 3/1981 | Keller | 273/29 A |
| 4,664,375 | 5/1987 | Tetreault | 273/26 E |
| 4,867,448 | 9/1989 | Judd | 273/26 E |
| 5,083,775 | 1/1992 | Heard | 273/26 E |

FOREIGN PATENT DOCUMENTS

| | | | |
|---|---|---|---|
| 2652655 | 5/1978 | Fed. Rep. of Germany | 273/29 A |
| 378238 | 8/1932 | United Kingdom | 273/190 R |
| 1023771 | 3/1966 | United Kingdom | 273/413 |

*Primary Examiner*—Theatrice Brown

*Attorney, Agent, or Firm*—Harness, Dickey & Pierce

[57] ABSTRACT

The invention relates to a tethered ball pitching device wherein a planar base member is provided with a plurality of ground penetrating planar teeth members and a central aperture, a vertically extending support member having a pointed end extending through the aperture for penetration into the ground, a davit shaped member having a vertical extending support member and a horizontal portion having an aperture through its outer end, a ring extending through the aperture, and an elastic cord having one of its ends attached to the ring, the other end of the elastic cord is attached to a ball.

14 Claims, 4 Drawing Sheets

TETHERED BALL PITCHING APPARATUS AND METHOD

This is a division of U.S. patent application Ser. No. 07/613,277, filed Nov. 14, 1990 (U.S. Pat. No. 5,056,781).

BACKGROUND OF THE INVENTION

The present invention relates to practice device in which a ball is used, and more particularly to practice wherein a ball is struck after delivery to a player standing at a particular point.

In games utilizing a ball, including cricket, bounders, tennis, racquetball, and in particular for example, baseball, every player on a team, with some exceptions, takes a turn at striking the ball. In baseball, practice batting usually entails a pitcher throwing balls to the practice batter. Given the large number of players needing batting practice with respect to the relatively smaller number of pitchers, a typical batting practice might unduly tire or even injure pitcher's pitching arm. Therefore, the need for a suitable pitching apparatus and method for pitching is especially acute, and such a device, if available, would be of tremendous benefit for batting practice.

Art relating to the use of batting practice devices includes U.S. Pat. No. 3,540,726 to Richard S. Davis, entitled, "Batting Practice Apparatus" and discloses a rotary vertical pole having a drill-type handle to swing a horizontal member in a circle. At the end of the horizontal member, a ball flies in a circular arc within the reach of a batter. U.S. Pat. No. 3,658,330 to Maestracci et al, entitled, "Device for Lawn Tennis Training" discloses a tennis ball suspended in a "Y" fashion between two poles. The player hits the ball which swings over the top and back into the player's field of play. U.S. Pat. No. 4,127,268 to Thomas E. Lindgren, entitled, "Tethered ball and Method of Manufacture" discloses a ball tethered at the end of an elastic tape which is attached to the wrist of the player. Another device, embodied in U.S. Pat. No. 4,057,248 to William J. Stoecker, entitled, "Baseball Practice Device" includes a pair of ground engaging panels forming a pitcher's mound and batter's plate which are connected by cords to mark a known distance between the panels, for manual pitching practice. In U.S. Pat. No. 4,032,145 to Max M. Tami entitled, "Action Batter-Up Game Apparatus" a hand held rope with ball attached is swung over the trainer's head. The ball is swung into the vicinity of a trainee who attempts to strike the ball. A similar type apparatus is disclosed in U.S. Pat. No. 4,186,921 to Daniel W. Fox, entitled "Method of Making a Tethered Ball Apparatus," which discloses a whiffle type ball mounted at the end of a cord having a handle. The ball is then swung overhead, within the reach of a practice batter.

The use an elastic or resilient means for devices propelling a ball include U.S. Pat. No. 2,017,720 issued to Philip Lake, entitled, "Apparatus for Practicing Ball Games" and discloses a rotatable member having an obtuse angle which is swivelable in a horizontal plane. At the upper end of the swiveling member is attached an elastic cord having a ball at its end. U.S. Pat. No. 3,788,297 to Walter Borst, entitled "Ball Pitching Device," discloses a tethered ball with the tether anchored to the ground, and a catapult type pitching apparatus to propel the ball at a batter.

British Patent No. 434,143 discloses a right angle pole which forms a suitable wicket and captive ball which, if hit by a cricket bat, will enable the ball to rebound back to the batsman. If the batsman is not vigilant in continuing to hit the ball swingable in a circle, the bails included in the apparatus will be knocked off, causing him to be out. U.S. Pat. No. 3,297,321 to V. D. Kuhnes, entitled "Baseball Batting Trainer," discloses a ball tethered at the end of a series combination of a cord, weight, and spring. The end of the spring is attached into the ground. A pitcher throws the ball at a batter, but in the event the batter strikes the ball, its range of flight is limited due to its being tethered to the ground.

In U.S. Pat. No. 3,767,198 to Ralph C. Boyer, entitled "Batting Practice Device and Method," an elastic trampoline shock cord is fixed at one end to the ground and at the other end to a cord having a ball attached. A pitcher pulls the cord and ball, releasing it in the direction of the batter. U.S. Pat. No. 3,011,784 to Angelo Segretto discloses a backstop, batter's box, and an elastic cord tethered to the back of home plate. An optional tethering pole is disclosed, which may be positioned between the pitcher and batter. The patent also discloses a drilled hole into a stitched baseball as a means to attach the ball to the end of the tether. By changing the location of the point of entry of the hole on the ball's surface, the ability to produce a curved pitch may be possible.

In view of the shortcomings inherent in the foregoing, what is needed is an accurate, resilient pitching apparatus and method which will provide a convenient, portable means to provide simulated pitching. Also needed is a pitching apparatus and method which will not necessitate the continual remeasurement of the dimensions necessary for setting up the device. What is also needed is a method whereby curve balls can be produced without the need for a collection of separate balls, each one having a hole drilled therein at a different angle with respect to the stitching. Also needed is a pitching apparatus and method utilizable on a concrete, paved or other hard surfaces. Also needed is a pitching apparatus and method which will enable an inexperienced person to pitch a ball to consistently reach a selected location near the strike zone of a batter or other ball hitter, which is relatively inexpensive and which limits the flight of a hit baseball to facilitate retrieval.

SUMMARY OF THE INVENTION

In accordance with one embodiment of the present invention, an apparatus and method are provided for pitching a ball to a batter, said pitching controllable according to the point from which the ball is released. In one embodiment, the apparatus includes a base portion having a tapering center spike for insertion into the ground with a planar center portion to facilitate the driving of the spike into the ground such as with a mallet or the like. The planar portion forms a hilt having a plurality of vertical teeth, which also are pushed into the ground to add rigidity and stability and to prevent rotation about the center of the spike. A davit-shaped upper member has a vertical and a horizontal portion, the horizontal portion terminating in a tapered end and having an aperture. One end of an elastic cord is connected to a ring which extends through the aperture of the tapered end. The other end of the elastic cord is connected to a ball. A home plate, or batting marker, and a pitching marker each locatable with a measuring cord of pre-specified length, is also included.

An alternate embodiment includes a rectangular shaped container which can be filled with water, sand, or other dense material. The container forms a base upon which a davit-shaped upper member is affixed. The elastic cord is connected to the davit-shaped upper member in the same manner as in the first embodiment.

The method of the present invention includes the carriage of the ball to the pitching marker area causing the stretchable extension of the elastic cord. The pitcher may release the ball at various distances from the davit shaped member and therefore at various point horizontal to the pitching marker. The ball may be released at various heights above the ground and at various angles with respect to the point of attachment of the elastic cord to the davit shaped upper member. The stitching on the ball may be adjusted with regard to its angle of attachment on the elastic cord in order to yield straight or curved flight towards the batting marker. The elastic cord is stretched, usually to about 90% of its maximum length. Upon release of the ball, it travels to an area near the batter, or batting marker.

The novel features of the invention are set forth with particularity in the appended claims. The invention would be best understood from the following description read in conjunction with accompanying drawings.

DESCRIPTION OF THE PREFERRED EMBODIMENT

Figure 1:
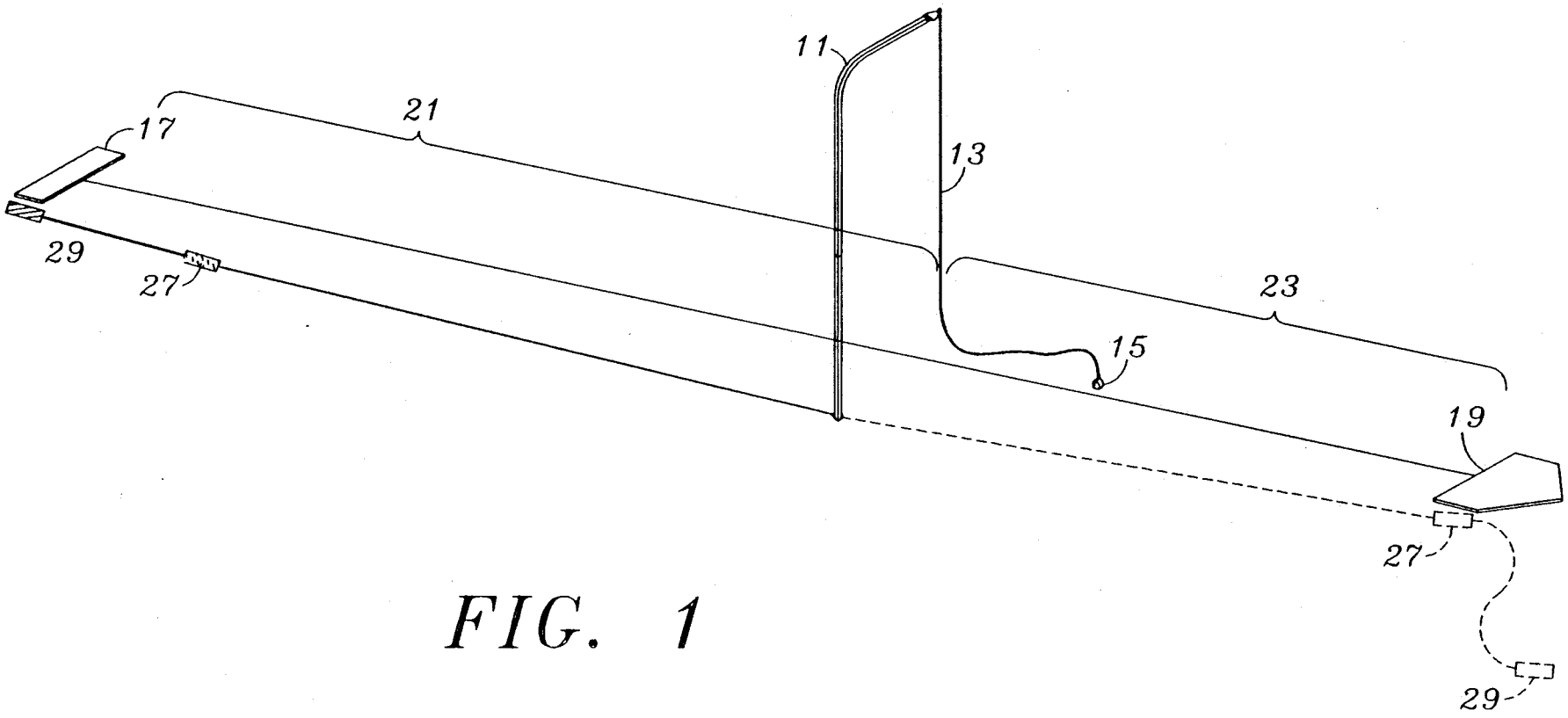
FIG. 1 is a perspective view of the pitching apparatus of the present invention, illustrating the relative location of its components.

FIG. 1 illustrates a perspective view of davit-shaped support 11 extending upwardly from the ground and to the right. An elastic cord 13 having a ball 15 at the end thereof is connected to the support 11. A pitching marker 17 and a batting marker 19 are spaced at distances 21 and 23, respectively, from davit-shaped support 11. Note that the upper end of davit-shaped support 11 extends vertically over the junction of distances 21 and 23. A pre-specified length of line 25 is attachable to the base of davit-shaped support 11 to measure out the locations of pitching marker 17 and batting marker 19. Measuring line 25 has colored links or other markings schematically indicated by cross-hatched bar 27 and transverse hatched bar 29 to indicate the preferred location of batting marker 19 and pitching marker 17, respectively. To the upper left of FIG. 1 the measuring line 25 and the transverse hatched bar 29 is fully extended to locate the pitching marker 17. To the lower right of FIG. 1 the measuring line 25 and the cross-hatched bar 27 is extended to locate the batting marker 19. In the second case, note that the part of the measuring line 25 between the markers 27 and 29 is not extended because distance 23 is not as long as distance 21.

Measuring line 25 may be further subdivided to indicate the proper distances, for example in the sport of baseball, for Little League, softball, and Major League ball. Similar marks may be had for subdivisions relating to tennis, squash, racquetball and the like.

Figure 2:
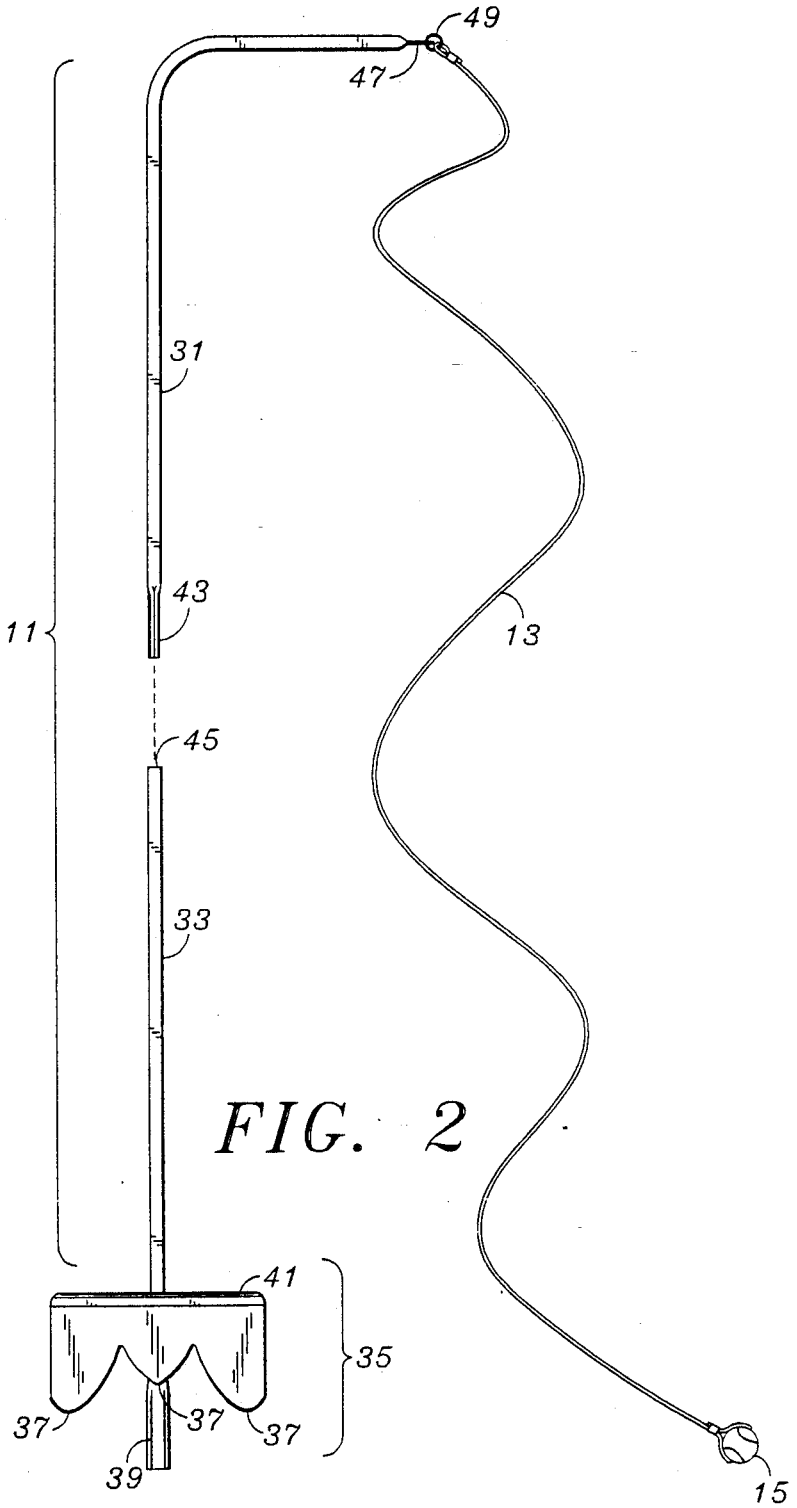
FIG. 2 is a front view of the pitching apparatus illustrated in FIG. 1.

Referring to FIG. 2, davit shaped support 11 is seen in partially exploded form consisting of a davit shaped upper member 31 and a vertically oriented base portion 33. Vertically oriented base portion 33 has a hilt portion 35 having three front teeth 37 vertically extending from the longer edge of hilt 35. Vertically oriented base portion 33 also includes a tapering center spike member 39 for insertion into the ground. Typically, spike portion 39 and teeth 37 all extend into the ground with only the upper planar portion of hilt 35 exposed. A wooden or hard rubber plate 41 lies atop hilt 35 to assist the driving of the hilt 35 and teeth 37 into the ground to achieve superior rigidity of davit-shaped support 11.

Figure 3:
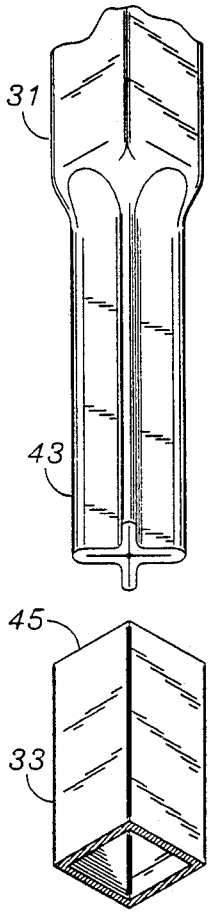
FIG. 3 illustrates the detail of fit of bottom swaged portion of the upper davit shaped member into the upper end of the base portion, as was previously shown in FIG. 2.

The davit shaped upper member 31 has an end section of swaged length 43 for close fittable insertion within the open upper end of base portion 33 generally designated by the numeral 45, and as also shown in FIG. 3. Davit-shaped upper member 31 has a horizontal portion terminating in a tapering portion 47. Attached to tapering portion 47 is a ring 49. Ring 49 extends through an aperture (not shown in FIG. 2). One end of the elastic cord 13 is secured to the ring, and the other end of elastic cord 13 is secured to ball 15.

FIG. 3 illustrates a detail of the swaged portion 43 of davit-shaped upper member 31 in close proximity to the upper open end 45 of vertically oriented base portion 33. The material from which the davit-shaped upper member 31, and vertically oriented base portion 33 are made, may be identical. This is because the swaged section 43 may be sufficiently reduced in dimension, to yield the resulting shape seen in FIG. 3, which is fittable within end 45. The swaged portion 43 prevents axial and rotatable movement of davit-shaped upper member 31 with respect to vertically oriented base portion 33.

Figure 4:
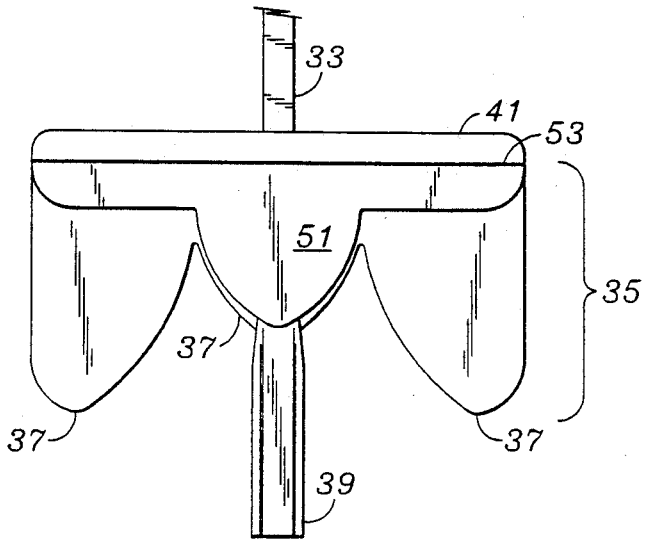
FIG. 4 is an enlarged view of the base portion of the apparatus shown in FIG. 1 from the back side.

Referring to FIG. 4, the back side of hilt 35 of vertically oriented base portion 33 is illustrated, showing a back tooth 51 in addition to the aforementioned three teeth 37, both of which are along both of the longer edges of hilt portion 35. Note that teeth 37 are longer than tooth 51. Also visible in FIG. 4 is the plate 41. Plate 41 rests atop a planar surface whose edge 53 is visible in FIG. 4. Teeth 37 and 51 extend from the longer edges of the planar surface.

Figure 5:
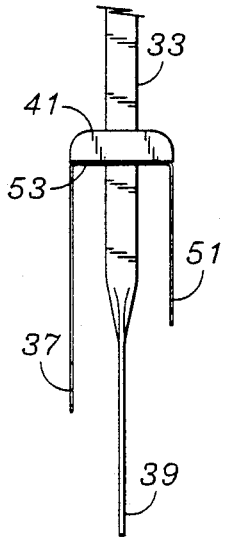
FIG. 5 is a side view of the base portion as was previously shown in FIGS. 2 and 4.

Referring to FIG. 5, a side view of hilt portion 35, as was shown in FIG. 4 is illustrated. Teeth 37 and 51 can be seen spaced apart from tapering center spike member 39. From FIGS. 1-5 it can be seen that hilt 35 provides support for teeth 37 and 39 and has adequate spacing between the teeth 37 and 51 and the center spike 39 to form a close fit into the earth. Hilt 35 also sets the extent to which spike portion 39 is extended into the earth, and thereby defines the height of davit-shaped support 11 of FIG. 1 when it is in operating position. Such consistent definition of height contributes to the precision height of davit-shaped support 11 attainable with each successive ground installation.

Figure 6:
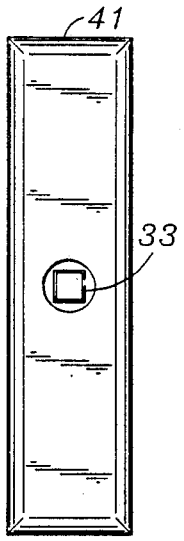
FIG. 6 is a top view of the base portion of FIGS. 2, 4, and 5 with the upper davit shaped member removed.

Referring to FIG. 6, a top view of the hilt portion 35 of FIGS. 4 and 5 is shown truly illustrating the presence of plate 41 and the location of vertically oriented base portion 33.

Figure 7:
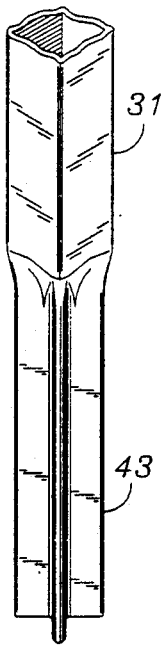
FIG. 7 illustrates the lower swaged section of the upper davit shaped member shown in FIG. 1.

FIG. 7 illustrates a detail of the swaged portion 43 of the upper davit shaped member 31 as was previously shown in FIGS. 2 and 3. All four surfaces are swaged inwardly at their centers to form a somewhat star-shaped pattern.

Figure 8:
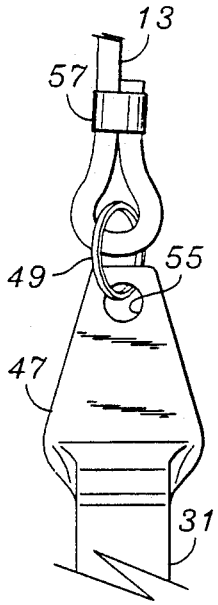
FIG. 8 is a detailed view of horizontal tapered end portion of the upper davit shaped member shown in FIG. 1.

FIG. 8 illustrates the details of the attachment of elastic cord 13 to the ring 49, and connection of the ring 49 through an aperture 55 in the tapered portion 47 of the horizontal portion of the davit shaped upper member 31. The top view of FIG. 8 illustrates the extension of elastic cord through ring 45. There is a section of elastic cord 13 which extends through ring 49 and securely back onto itself by means of a clamp 57. Ring 49 allows elastic cord 13 to pivot freely about davit-shaped support 31 without tangling or becoming caught.

Figure 9:
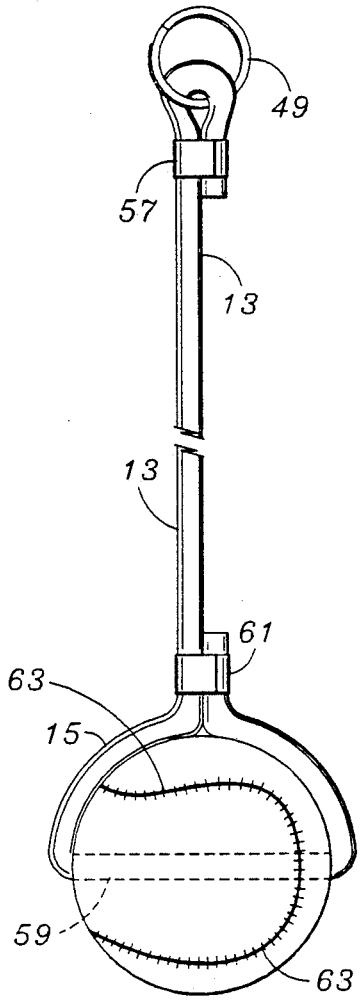
FIG. 9 illustrates the details of the attachment of the elastic cord shown in FIGS. 1 and 2 to the attachment ring shown in FIGS. 2 and 7 and the ball of FIGS. 1 and 2.

FIG. 9 illustrates the ring 49 and clamp 57 as was previously shown in FIG. 8, of elastic cord 13, shown in broken length format. Also shown is the extension of elastic cord 13 through a linear aperture or bore shown in dashed line format, generally designated by the numeral 59 extending into ball 15. Note that elastic cord 13 extends through a clamp 61, and along the surface of ball 15, entering one end of bore 59, extending through ball 15, exiting the other end of bore 59, and extending along the surface of ball 15 to finally terminate within clamp 61. The section of elastic cord 13 which extends from clamp 61 through bore 59 is generally kept in tension. The overall length of elastic cord, when not in tension, is insufficient to extend from davit-shaped support 11 to pitching marker 17. The length of elastic cord 13 may be sufficient to extend without stretching to batting marker 19, especially if no deceleration of ball 15 is desired before ball 15 reaches batting marker 19.

Ball 15 has a continuous length of stitching 63 as is typical in the case of a baseball. It is readily seen that ball 15 may be rotated about the linear axis of the bore 59 to change the relative position of the stitching 63 with respect to the lengths of elastic cord 13 which lie adjacent to the surface of ball 15 between aperture 59 and clamp 61. The tension in the section of elastic cord between aperture 59 and clamp 61 enables the position of ball 15, and therefore stitching 63 to remain relatively constant with respect to clamp 61 unless deliberately changed. This is particularly relevant since the configuration herein is such that ball 15 approaches batting marker 19 with elastic cord 13 trailing behind. Therefore, the position of the stitching 63 lying opposite the hemisphere of ball 15 adjacent clamp 61, is the position which will be seen by an observer at batting marker 19.

Figure 10:
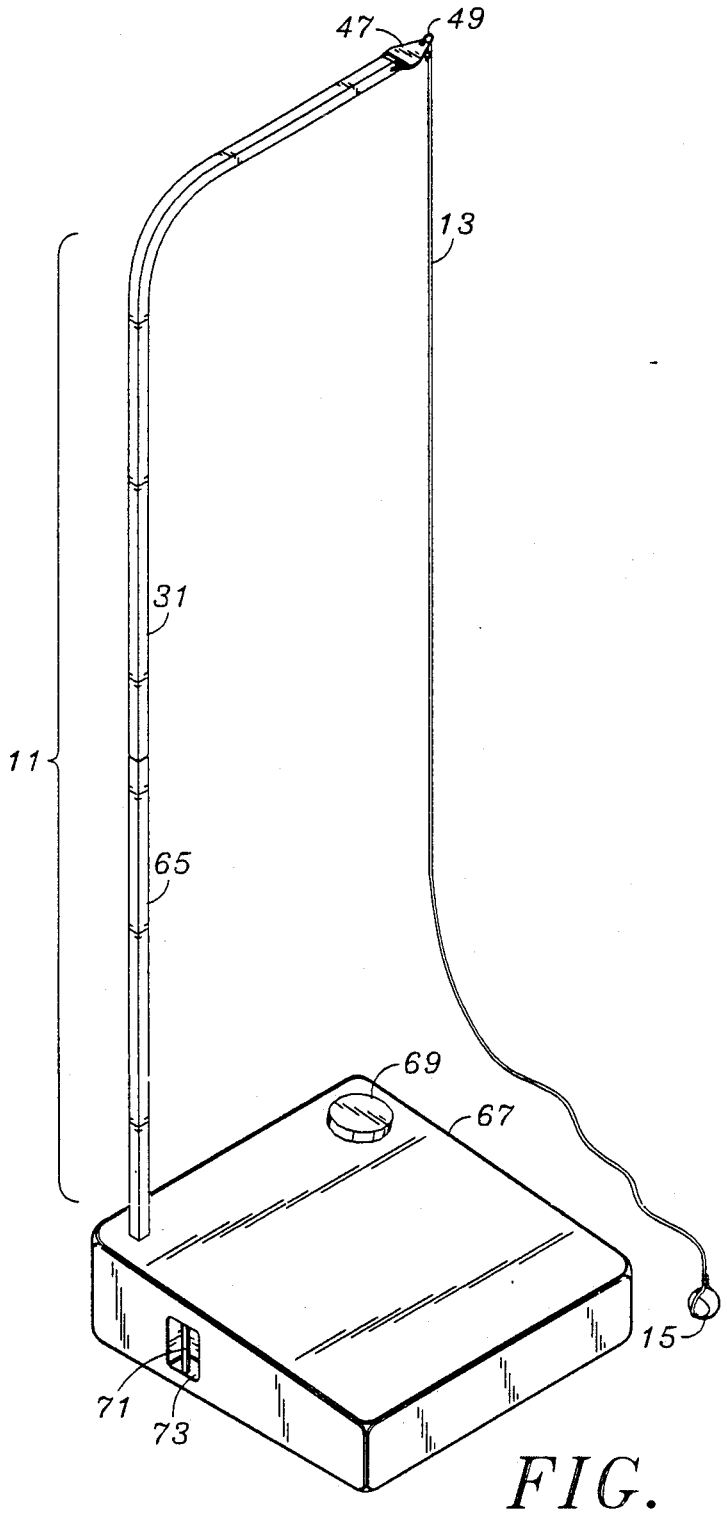
FIG. 10 illustrates an alternate embodiment of the pitching apparatus shown in FIGS. 1-9.

Referring to FIG. 10, an alternate embodiment of the present invention is illustrated. Davit-shaped support 11 is illustrated generally as before, including davit-shaped upper portion 31, tapering portion 47, ring 49, elastic cord 13, and ball 15. However, the vertically oriented base portion 33 of FIGS. 2–4 is replaced by a base portion 65 attached to a generally hollow, rectangular solid shaped base 67. Base 67 is fitted with a filler cap 69 and a securing pin 71 within a securing aperture 73. Base portion 65 is attached near a corner of base 67 in order to provide maximum rotational and non-tilting stability to davit-shaped support 11 when ball 15 is stretchably extended for release. this is particularly important to prevent a discontinuous or jerky flight of the ball which would occur if the davit-shaped support 11 were unstable.

Base 67 is designed to be filled, upon removal of filler cap 69 with sand, water, or any other dense material to lend base 67 sufficient weight for operation. Base 67 and base position 65 also enables the pitching apparatus of the present invention to be used indoors, in garages, gymnasiums and warehouses. This is particularly useful for winter practice where the weather in inclement and outside practice is not practicable.

The operation of the pitching apparatus and method as previously described is as follows. Vertical spike 39 and teeth 37 and 51 of vertical base portion 33 are thrust into the ground. Plate 41 on hilt portion 35 is for facilitating displacement into the ground, such as by pounding with a mallet, to lend the additional force which may be needed to properly implant base portion 33. Davit-shaped upper member 31, and in particular swaged section 43 is fitted within the open end 45 of the upper portion of base portion 33. Davit-shaped upper portion 31 has elastic cord 13 and ball 15 attached at the upper end. Batting marker 19 is placed a distance 23 from davit-shaped support 11 by measuring with measuring cord 25, as is pitching marker 17 and its associated distance 21. The markers or bars 27 and 29 on measuring cord 25 are used to help gauge the relative distance from support 11 from which ball 15 is to be released and from which ball 15 is to be struck. Generally, the distance between support 11 and batting marker 19 will be less than the distance between support 11 and pitching marker 17.

To operate the pitching apparatus, a pitcher grasps ball 15 and walks towards pitching marker 17. As the pitcher approaches pitching marker 17, the cord 13 begins to stretch which, in turn, begins to exert a force on ball 15 in the direction of davit-shaped support 11, which is, of course, opposed by the pitcher. This action also places significant bending moment and axial torque forces upon davit-shaped support 11, which due to the firm anchoring support and close fitting nature of swaged section 43, does not bend or twist. As a batter prepares to strike the ball, he stands near batting marker 19.

The pitcher can position the ball 15 to a point of release farther toward the ground, or away from the ground, to the left or right, in a direction transverse to the force exerted by elastic cord 15, and also may position the ball closer to or farther from davit-shaped support 11. The pitching marker 17 facilitates finer adjustments on the position of ball 15 by providing a background reference by which to judge the relative position of the pitcher, and the point from which the pitcher releases the ball 15. As the pitcher releases ball 15 from a point adjacent pitching marker 17, ball 15 accelerates due to the tension forces developed in elastic cord 13 due to its stretchable extension to pitching marker 17. Due to the stability of davit-shaped support 11, a smooth acceleration is had, allowing a consistently accurate flight of ball 15. Ball 15 accelerates, then passes davit shaped support 11, with elastic cord 13 trailing behind, and proceeds toward the batting marker 19. When batting marker 19 is positioned closely enough to davit-shaped support 11, the ball 15 will be near maximum velocity by the time it crosses batting marker 19, and, which may reach speeds in excess of 67 miles per hour. A batter standing near batting marker 19 then strikes the ball, whose flight is limited by virtue of ball 15's attachment to davit shaped support 11. Once the ball 15 comes to rest, the pitcher retrieves the ball 15, and the process is then repeated.

The velocity of ball 15 as it approaches batting marker 19 is dependent upon the tension forces developed in elastic cord 13 and therefore, the distance to which the pitcher 17 extends the ball before release. The level of ball 15 above the ground near pitching marker 17 will determine the trajectory of ball 15 and therefore the level of the point at which ball 15 crosses batting marker 19. If ball 15 is released from a low level, it will cross batting marker 19 at a high level. If ball 15 is released from a high level, it will cross batting marker 19 at a low level. If a pitcher releases the ball from a point to the right of the pitcher, the ball 15 will cross the batting marker to the right from the batter's perspective. Likewise, if a pitcher releases the ball from a point to the left of the pitcher, the ball 15 will cross the batting marker at a point to the left with respect to the batter's perspective.

In instances where the playing surface is hardened, as for example concrete and asphalt, the embodiment which was shown in FIG. 10 may be employed. Davit-shaped support 11 and base 67 can be set up before or after base 67 is filled with a suitable weighting material. Once filled, base 67 is designed to be employed within the perspective diagram of FIG. 1 with the greater length of base 67 from its point of attachment of base portion 65 extending generally from base portion 65 to pitching marker 17. Operation of the pitching device is in the same manner as previously described.

Although the dimensions of the pitching apparatus of the present invention may be varied, some dimensions, of course, were better than others. It has been found satisfactory to set the height of tapered portion 47 of davit-shaped support 11 approximately five feet above the ground. An elastic cord having an unstretched length of about eight feet and a diameter of approximately 3/16 of an inch has been found to work satisfactorily. The location of the pitching marker 17 at a distance of 18 ft. from vertically oriented base portion 33, and the location of the batting marker at a distance of about 13 ft. from vertically oriented base portion 33 has been found to be satisfactory. It has been found that when the ball is pulled to the pitching marker, stretching the elastic cord 13 to about 90% of its length caused the ball to reach the batting marker with high consistency and with the cord trailing behind the ball. As has been previously stated, since the elastic cord 13 trails ball 15, the adjustment of ball 15 and the stitching 63, with respect to clamp 61 will alter the stitching profile of ball 15 as it approaches the batting marker. It has been previously shown that such an alteration can cause a different path of flight, as between a straight flight and curved flight.

Thus, the invention provides an apparatus and method for the pitching of a baseball so that it arrives at a batting marker in a manner simulating an actually pitched ball, such as a baseball. The ball 15 of the present invention can therefore be pitched consistently by a relatively unskilled person. Optionally, pitching marker 17 and batting marker 19 may be attached to vertically oriented base portion 33 of davit-shaped support 11. The attachment of the pitching marker 17 and batting marker 19 to the vertically oriented base portions 65 or 33 would eliminate the necessity for measuring and remeasuring their distances from base portions 65 and 33 each time the pitching apparatus of the present invention is relocated.

The foregoing disclosure and description of the invention are illustrative and explanatory thereof, and various changes in the physical dimensioning, materials employed, and configuration of the pitching apparatus and method of the present invention may be made without departing from the spirit and scope of the invention, and it is intended that the claims herein be interpreted to cover such modifications and equivalents.

What is claimed is:

1. A pitching apparatus for pitching a ball to a batter comprising: a hollow rectangular shaped base, having a filler aperture, a filler cap fixably attachable over said filler aperture, a vertically oriented base portion having an open upper end and a lower end fixedly and non-rotatably attached near a corner of said base; an upper, davit-shaped member having a vertically oriented portion connected to the upper end of said vertically oriented base portion, and a horizontally oriented portion having an aperture at its end; an elastic cord having a first end secured to a ring, said ring extending through said aperture, and a second end attached to a ball, said elastic cord having a length at least equal to or greater than the combined length of the vertically oriented portion.

2. The pitching apparatus of claim 1 wherein said vertically oriented portion is a hollow square tubular section which terminates in a swaged section and is fitted within said upper end of said vertically oriented base portion which is a hollow square tubular section.

3. The pitching apparatus of claim 1 wherein said horizontally oriented portion terminates in a tapering portion and said aperture is located through said tapering portion.

4. The pitching apparatus of claim 1 wherein, said ball a bore extended completely therethrough, said second end of said cord extending through said bore and secured to a portion of the length of said cord extending into said bore, the axis of said bore being perpendicular to the axis of said cord between its first and second ends.

5. The pitching apparatus of claim 4 wherein said bore of said ball has a linear axis.

6. The pitching apparatus of claim 5 wherein said ball has stitching and wherein said ball is rotatably fixed with respect to said cord about said linear axis bore to allow variable orientation of said stitching with respect to said second end of said cord.

7. The pitching apparatus of claim 6 wherein said second end of said cord extend in, through and out of said bore and is secured to a portion of said cord by a clamp, in elastic tension said cord being in said bore to prevent free rotation of said ball on said cord.

8. The pitching apparatus of claim 4 wherein at least one side of said rectangular shaped base said base a securing pin within a recess for anchoring said rectangular shaped base.

9. The pitching device of claim 4 further comprising a batting marker for placement on the ground, and located a suitable distance from said vertically oriented base portion.

10. The pitching apparatus of claim 9 further comprising measuring means, attached to said vertically oriented base portion, for locating said batting marker a predetermined distance from said vertically oriented base portion.

11. The pitching device of claim 9 further comprising a pitching marker for placement on the ground, and located a suitable distance from said vertically oriented base portion.

12. The pitching apparatus of claim 11 further comprising measuring means, attached to said vertically oriented base portion, for locating said pitching marker and said batting marker a predetermined distance from said vertically oriented base portion.

13. The pitching device of claim 4 further comprising a pitching marker for placement on the ground, and located a suitable distance from said vertically oriented base portion.

14. The pitching apparatus of claim 13 further comprising measuring means, attached to said vertically oriented base portion, for locating said pitching marker a predetermined distance from said vertically oriented base portion.

* * * * *